US005188509A

United States Patent [19]

Shimanuki et al.

[11] Patent Number: 5,188,509

[45] Date of Patent: Feb. 23, 1993

[54] WATER PUMP FOR INTERNAL COMBUSTION ENGINE

[75] Inventors: Shizuo Shimanuki, Anjo; Yoshitomo Nakai; Masamichi Itakura, both of Toyota, all of Japan

[73] Assignees: Aisin Seiki Kabushiki Kaisha, Kariya; Toyota Jidosha Kabushiki Kaisha, Toyota, both of Japan

[21] Appl. No.: 733,868

[22] Filed: Jul. 22, 1991

[30] Foreign Application Priority Data

Jul. 31, 1990 [JP] Japan ..... 2-81267[U]

[51] Int. Cl.[5] ..... F04D 29/70

[52] U.S. Cl. ..... 415/208.1; 415/211.2

[58] Field of Search ..... 415/121.2, 170.1, 182.1, 415/208.1, 211.2

[56] References Cited

U.S. PATENT DOCUMENTS 3,076,412 2/1963 Harker ..... 415/170.1
3,829,238 8/1974 Speck ..... 415/200

FOREIGN PATENT DOCUMENTS 151196 11/1980 Japan ..... 415/208.1
128319 8/1989 Japan .
1033954 6/1966 United Kingdom ..... 415/121.2

*Primary Examiner*—John T. Kwon
*Attorney, Agent, or Firm*—Oblon, Spivak, McClelland, Maier & Neustadt

[57] ABSTRACT

A water pump for an internal combustion engine includes a body, a driving shaft held rotatably in the body, an impeller fixed on the driving shaft, a volute chamber formed in the body and including a deflecting portion adapted for introducing a coolant to an outlet port, a chamber formed in the body on a back side of the impeller and including an inner circumferential portion and an outer circumferential portion, and at least two ribs disposed so as to connect the inner circumferential portion and the outer circumferential portion of the chamber, one of the ribs disposed adjacent to the deflecting portion of the volute chamber, whereby inibiting foreign matters contained in the coolant from being left in a space formed between the inner circumferential portion and the outer cicumferential portion of the chamber. When foreign matters are contained in the coolant and when the foreign matters intrude into the chamber, the foreign matters collide with the ribs. The ribs immediately evacuate the foreign matters back to either the volute chamber or the outlet port by way of an outlet passage. Thus, the foreign matters are not kept to circulate in the chamber, and accordingly the erosion of the body can be inhibited from happening.

7 Claims, 3 Drawing Sheets

WATER PUMP FOR INTERNAL COMBUSTION ENGINE

BACKGROUND OF THE INVENTION

1. Field of the Invention

The present invention relates to a water pump for an internal combustion engine. More particularly, the present invention relates to erosion and water leakage prevention for a water pump for an internal combustion engine.

2. Description of the Prior Art

A lot of water pumps for an internal combustion engine have been proposed so far. For instance, a water pump is disclosed in Japanese Examined Utility Model Publication (KOUKOKU) No. 28319/1989, and will be hereinafter described with reference to FIG. 6. The water pump 60 includes a pump body 61, a pump cover 62, a volute chamber 63 formed in the pump body 61 and the pump cover 62, a driving shaft 65 held rotatably in the pump body 61 by way of a bearing 64, and a mechanical seal 66 disposed on the driving shaft 65 between the volute chamber 63 and the bearing 64. The pump body 61 and the pump cover 62 are separate and divided component parts, and are usually formed of an aluminum material.

Further, a pulley 67 is fixed on an end of the driving shaft 65 so as to input a driving force to the driving shaft 65. Furthermore, an impeller 68 is fixed on the opposite end of the driving shaft 65. Moreover, a chamber 69 is formed in an annular shape in the pump body 61 on a back side of the impeller 68 so as to inhibit the pump body 61 from being failingly cast.

There are foreign matters (for instance, casting sands or the like having been left in the cylinder block of an engine) contained in a coolant. The foreign matters flow together with the coolant in a coolant circuit (not shown) into which the above-described conventional water pump 60 is disposed. When the foreign matters intrude into the chamber 69, the foreign matters are kept circulating in the chamber 69 together with the coolant flowing therein. As a result, the foreign matters gradually erode the wall surface of the pump body 61 away. Finally, there might be a fear for communicating the inside of the pump body 61 with the outside, and accordingly the coolant in the volute chamber 63 might leak to the outside.

SUMMARY OF THE INVENTION

The present invention has been developed in view of the above-described problem. It is therefore a primary object of the present invention to inhibit a body of a water pump, in which a chamber is formed, from eroding away.

The above and other objects can be achieved by a water pump for an internal combustion engine according to the present invention. The water pump comprises:

- a body;
- a driving shaft held rotatably in the body;
- an impeller fixed on the driving shaft;
- a volute chamber formed in the body and including a deflecting portion adapted for introducing a coolant to an outlet port;
- a chamber formed in the body on a back side of the impeller and including an inner circumferential portion and an outer circumferential portion; and
- at least two ribs disposed so as to connect the inner circumferential portion and the outer circumferential portion of the chamber, one of the ribs disposed adjacent to the deflecting portion of the volute chamber, whereby inhibiting foreign matters contained in the coolant from being left in a space formed between the inner circumferential portion and the outer circumferential portion of the chamber.

In the water pump according to the present invention, when the foreign matters contained in the coolant intrude into the space formed between the inner circumferential portion and the outer circumferential portion of the chamber, the foreign matters collide with the ribs. Then, the ribs evacuate the foreign matters from the space back to the volute chamber. Further, the one of the ribs disposed adjacent to the deflecting portion of the volute chamber evacuates the foreign matters from the space and introduces them into an outlet passage. Hence, the water pump according to the present invention can inhibit the erosion and the coolant leakage which are caused by the foreign matters from happening.

Here, one might point out that it is possible to inhibit the erosion and the coolant leakage from happening by making the body with cast iron which is strong against the erosion due to the foreign matter, or by increasing the wall thickness of the body on the back side of the impeller. However, the both measures result in an increasing weight of the water pump body, and accordingly there is not much merit in employing the measures. On the other hand, the water pump according to the present invention can not only inhibit the erosion and the coolant leakage from happening, but also can keep the weight of the water pump body lightweighted.

BRIEF DESCRIPTION OF THE DRAWINGS

A more complete appreciation of the present invention and many of its advantages will be readily obtained as the same becomes better understood by reference to the following detailed description when considered in connection with the accompanying drawings and detailed specification, all of which forms a part of the disclosure.

DETAILED DESCRIPTION OF THE PREFERRED EMBODIMENTS

Having generally described the present invention, a further understanding can be obtained by reference to the specific preferred embodiments which are provided herein for purposes of illustration only and are not intended to limit the scope of the appended claims.

First Preferred Embodiment

The preferred embodiments embodying the present invention will be hereinafter described with reference to the accompanying drawings.

Figure 1:
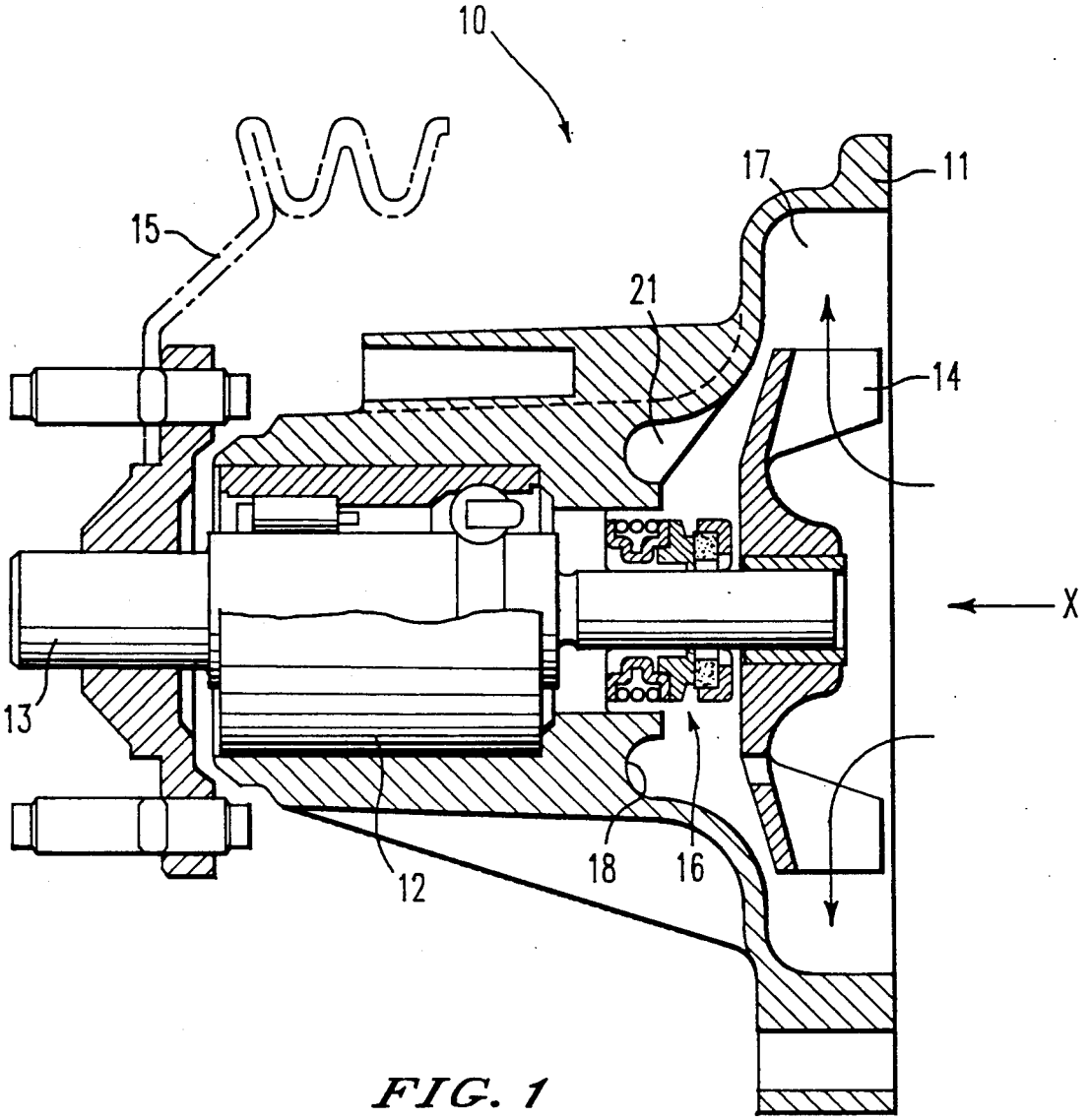
FIG. 1 is a cross sectional view of a water pump of a First Preferred Embodiment according to the present invention.
Figure 5:
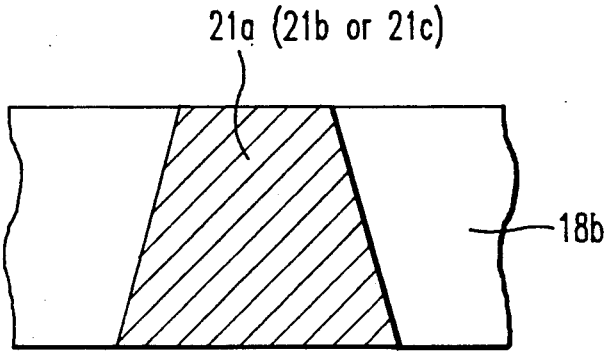
FIG. 5 is a cross sectional view of a modified version of the ribs which can be employed by the water pump of the First or Second Preferred Embodiment according to the present invention.
Figure 2:
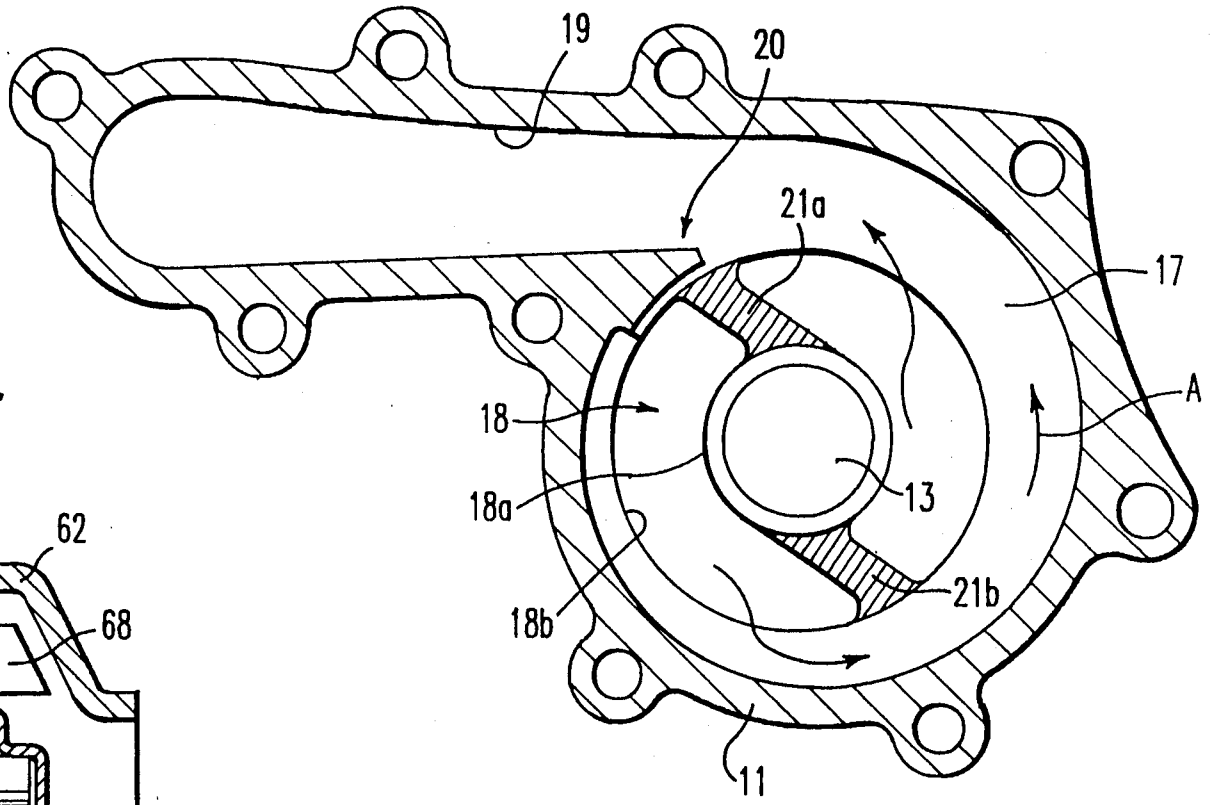
FIG. 2 is a fragmentary front view of the water pump of the First Preferred Embodiment according to the present invention taken in the direction of the arrow "X" of FIG. 1, but in which an impeller is removed.
Figure 6:
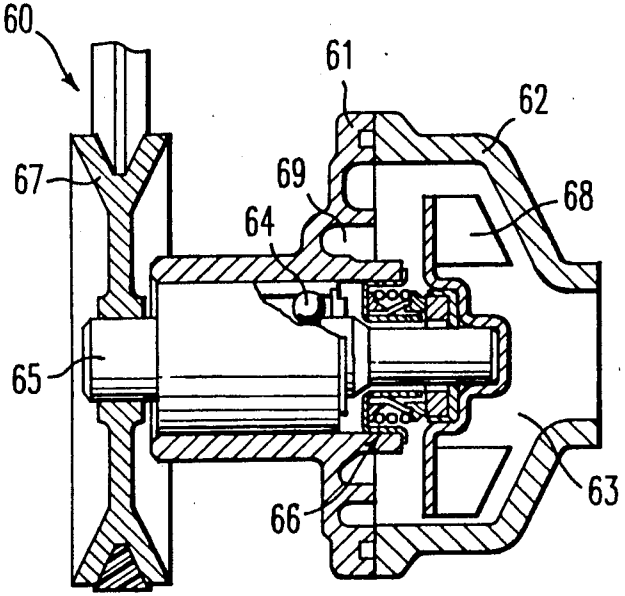
FIG. 6 PRIOR ART
FIG. 6 is a cross sectional view of a conventional water pump.

FIGS. 1 and 2 illustrate a water pump 10 for an internal combustion engine of the First Preferred Embodiment according to the present invention. The water pump 10 mainly includes a body 11, a driving shaft 13 held rotatably in the body 11 by a bearing 12, an impeller 14 fixed at one end of the driving shaft 13, and a volute chamber 17 formed in the body 11. Further, a pulley 15 is fixed at another end of the driving shaft 13, and is connected to an output shaft of an engine (not shown) by way of a belt (not shown). Furthermore, a mechanical seal 16 having a known construction is disposed between the bearing 12 and the impeller 14 in order to inhibit a coolant from intruding into the bearing 12.

As illustrated in FIG. 2, the body 11 includes an outlet passage 19 communicating with an outlet port (not shown). The outlet passage 19 communicates with the volute chamber 17. The volute chamber 17 includes a deflecting portion 20 at the connection between the volute chamber 17 and the outlet passage 19. The deflecting portion 20 of the volute chamber 17 is adapted for introducing the coolant to an outlet port (not shown) by way of the outlet passage 19. Further, the body 11 includes an annular-shaped chamber 18 formed therein on a back side of the impeller 14. The body 11 is usually made by casting so as to form the volute chamber 14 and the chamber 18 therein. The chamber 18 is formed in order to avoid the failure casting of the body 11, and includes an inner circumferential portion 18*a* and an outer circumferential portion 18*b*.

As also illustrated in FIG. 2, two ribs 21*a* and 21*b* are disposed in the chamber 18 so as to connect the inner circumferential portion 18*a* and the outer circumferential portion 18*b*. One of the two ribs 21*a* and 21*b*, namely the rib 21*a* is disposed adjacent to the deflecting portion 20 of the volute chamber 17, and the other rib 21*b* is disposed at a radially symmetrical position around the driving shaft 13 with respect to the rib 21*a* disposed adjacent to the deflecting portion 20. Namely, the two ribs 21*a* and 21*b* are disposed at two equally spaced positions in the chamber 18 (or at positions dividing the volume of the chamber 18 equally). Further, as can be seen from FIG. 2, the side surfaces of the two ribs 21*a* and 21*b* are sloped at a predetermined angle with respect to a radial direction of the chamber 18, or they are sloped with respect to the rotational direction of the impeller 14 shown by the arrow "A" of FIG. 2.

The operation of the thus constructed water pump 10 for an internal combustion engine will be hereinafter described. When the engine is operated and the driving shaft 13 is rotated, the impeller 14 disposed in the volute chamber 17 rotates to pressurize and deliver the coolant filled in a coolant circuit (not shown) from an inlet passage (not shown) to the outlet passage 19.

During the operation, when foreign matters (for instance, casting sands or the like having been left in the cylinder block of the engine) exist in the coolant circuit, the foreign matters intrude into the chamber 18 through the volute chamber 17 as the coolant flows from the inlet passage to the outlet passage 19. If that is the case, the foreign matters collide with the ribs 21*a* and 21*b*, and slide on the sloped side surfaces of the ribs 21*a* and 21*b* as the coolant flows swirlingly. Thus, the rib 21*b* immediately evacuates the foreign matters back to the volute chamber 17, and the rib 21*a*, disposed adjacent to the deflector portion 20 of the volute chamber 17, immediately evacuates the foreign matters back to the outlet passage 19. Consequently, the foreign matters are not kept to circulate in the chamber 18. Hence, it is possible to inhibit the erosion of the body 11 due to the foreign matters.

Figure 4:
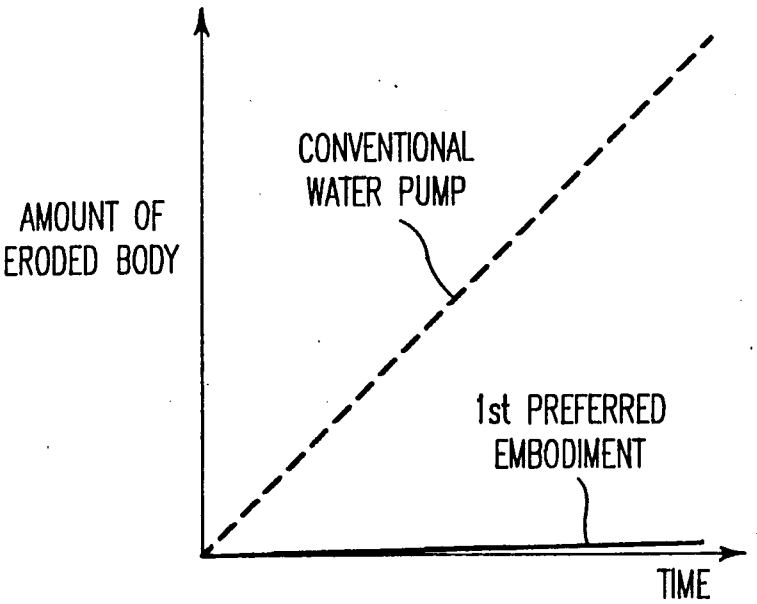
FIG. 4 is a graph illustrating the characteristic relationships between the time elapsed and the amounts of eroded body which were exhibited by the water pump of the First Preferred Embodiment according to the present invention and by a conventional water pump.

An evaluation test was carried out, in which the water pump 10 of the First Preferred Embodiment according to the present invention and a conventional water pump were operated to examine how much erosion occurs in the pumps. The results are shown in FIG. 4 which illustrates the characteristic relationships between the time elapsed and the amounts of eroded body. As can be understood from FIG. 4, the water pump 10 had a far better property against the erosion than the conventional water pump did.

Second Preferred Embodiment

Figure 3:
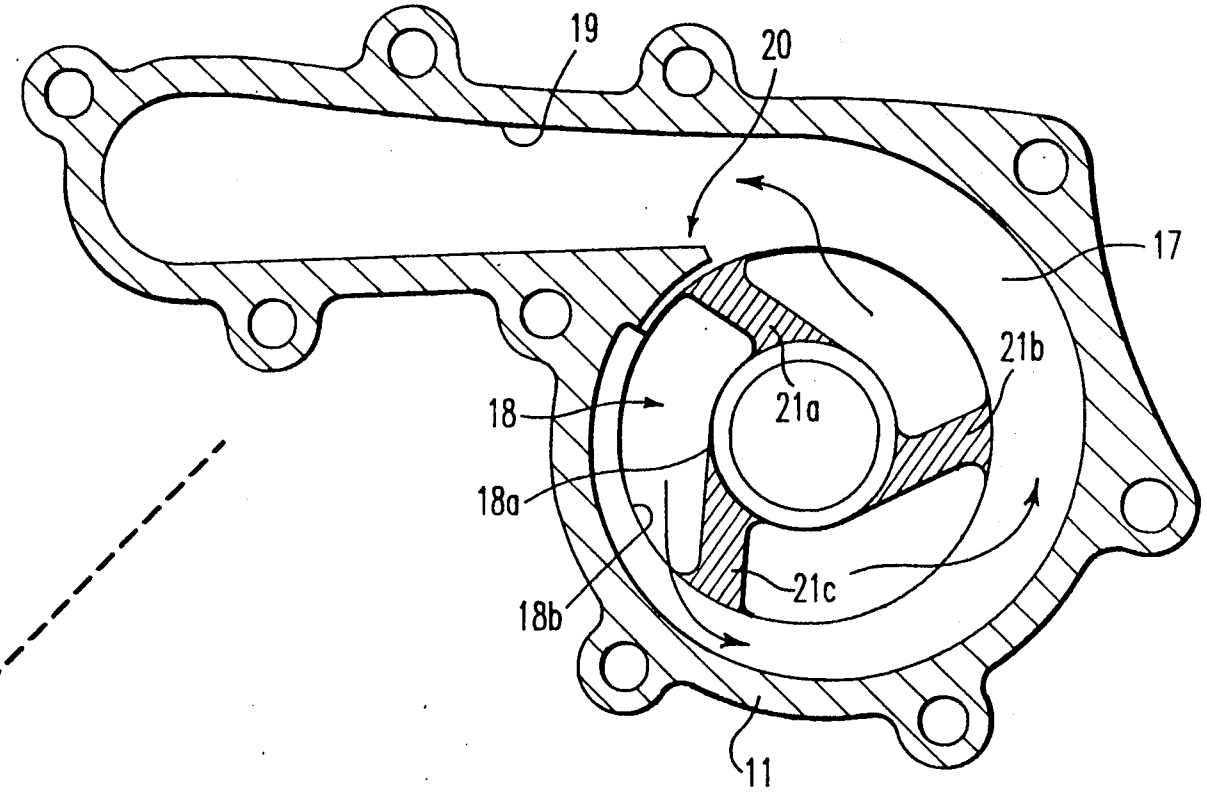
FIG. 3 is a fragmentary front view of a water pump of a Second Preferred Embodiment according to the present invention taken in the direction of the arrow "X" of FIG. 1, but in which an impeller is removed.

FIG. 3 illustrates a water pump 10 for an internal combustion engine of the Second Preferred Embodiment according to the present invention. The construction of the Second Preferred Embodiment is identical with that of the First Preferred Embodiment basically. In the Second Preferred Embodiment, three ribs 21*a*, 21*b* and 21*c* are disposed in the chamber 18 so as to connect the inner circumferential portion 18*a* and the outer circumferential portion 18*b*. The first rib 21*a* is disposed adjacent to the deflecting portion 20 of the volute chamber 17, the second rib 21*b* is disposed at a position equally spaced from the first rib 21*a* in a clockwise direction, and the third rib 21*c* is disposed at a position equally spaced from the first rib 21*a* in a counterclockwise direction. Namely, the ribs 21*a*, 21*b* and 21*c* are disposed at three equally spaced positions in the chamber 18 around the driving shaft 13. Likewise, as can be seen from FIG. 3, the side surfaces of the three ribs 21*a*, 21*b* and 21*c* are sloped at a predetermined angle with respect to a radial direction of the chamber 18, or they are sloped at a predetermined angle with respect to the rotational direction of the impeller 14 shown by the arrow "A" of FIG. 3.

The three ribs 21*a*, 21*b* and 21*c* work similarly as those of the First Preferred Embodiment. When foreign matters intrude into the chamber 18, the foreign matters collide with the ribs 21*a*, 21*b* and 21*c*, and slide on the sloped side surfaces of the ribs 21*a*, 21*b* and 21*c* as the coolant flows swirlingly. Thus, the first rib 21*a* immediately evacuates the foreign matters back to the outlet passage 19, and the second and third ribs 21*b* immediately evacuate the foreign matters back to the volute chamber 17. As a result, in the water pump 10 of the Second Preferred Embodiment, the body 11 is inhibited from eroding further reliably. In the Second Preferred Embodiment illustrated in FIG. 3 as well as the First Preferred Embodiment illustrated in FIG. 2, one of the ribs 21*a*, 21*b* and 21*c* is always disposed adjacent to the deflector portion 20 of the volute chamber 17.

Modified Version

In the water pump 10 of the First Preferred Embodiment or the Second Preferred Embodiment, it is preferable to form the ribs 21*a*, 21*b* and 21*c* in a form of a truncated cone gradually reducing the diameter thereof as they approaches the impeller 14. With this construction, the foreign matters can rise along the side surfaces of the ribs 21*a*, 21*b* and 21*c* further smoothly when they are evacuated back to the volute chamber 17 or the outlet passage 19. Accordingly, it is possible to further reduce the erosion of the body 11.

Having now fully described the present invention, it will be apparent to one of ordinary skill in the art that many changes and modifications can be made thereto without departing from the spirit or scope of the present invention as set forth herein including the appended claims.

What is claimed is:

1. A water pump for an internal combustion engine, comprising:

a body;

a driving shaft held rotatably in said body;

an impeller fixed on said driving shaft;

means for rotating said driving shaft such that the impeller is rotated in a rotating direction;

a volute chamber formed in said body and including a deflecting portion adapted for introducing a coolant to an outlet port;

a chamber formed in said body on a back side of said impeller and including an inner circumferential portion and an outer circumferential portion; and at least two ribs disposed in said chamber, one of the ribs being disposed adjacent to said deflecting portion of said volute chamber, whereby inhibiting foreign matters contained in said coolant from being left in a space formed between said inner circumferential portion and said outer circumferential portion of said chamber, wherein each of said ribs is radially outwardly sloped in the rotating direction.

2. The water pump for an internal combustion engine according to claim 1, wherein said two ribs are disposed at two equally spaced positions in said chamber.

3. The water pump for an internal combustion engine according to claim 1, wherein said ribs have a form of a truncated cone having a gradually reduced diameter as said ribs approach said impeller.

4. The water pump for an internal combustion engine according to claim 1, including three of said ribs, one of the ribs being disposed adjacent to said deflecting portion of said volute chamber.

5. The water pump for an internal combustion engine according to claim 4, wherein said three ribs are disposed at three equally spaced positions in said chamber.

6. The water pump for an internal combustion engine according to claim 4, wherein said ribs have a form of a truncated cone having a gradually reduced diameter as said ribs approach said impeller.

7. The water pump of claim 1 wherein each of said ribs connects said inner and outer circumferential portions of said chamber.

* * * * *